United States Patent [19]

Ashley

[11] 4,051,762

[45] Oct. 4, 1977

[54] LIQUID PROPELLANT WEAPON SYSTEM

[75] Inventor: Eugene Ashley, Burlington, Vt.

[73] Assignee: General Electric Company, Burlington, Vt.

[21] Appl. No.: 728,355

[22] Filed: Sept. 30, 1976

Related U.S. Application Data

[62] Division of Ser. No. 575,283, May 7, 1975, Pat. No. 4,011,817, and Ser. No. 707,144, July 20, 1976, which is a division of Ser. No. 469,507, May 13, 1974, abandoned.

[51] Int. Cl.[2] ..... F41F 1/04

[52] U.S. Cl. ..... 89/7; 102/38

[58] Field of Search ..... 102/38, 40, 43 R, 38 R; 89/7

[56] References Cited

U.S. PATENT DOCUMENTS

| | | | |
|---|---|---|---|
| 692,819 | 2/1902 | Bissell | 102/38 |
| 2,960,031 | 11/1960 | Clift | 102/38 X |
| 3,011,404 | 12/1961 | Russell | 102/38 UX |
| 3,065,695 | 11/1962 | Jarrett | 102/38 |
| 3,175,494 | 3/1965 | Turner | 102/38 |
| 3,326,084 | 6/1967 | Babieri et al. | 89/7 |
| 3,690,255 | 9/1972 | Vass et al. | 89/7 X |

FOREIGN PATENT DOCUMENTS

| | | | |
|---|---|---|---|
| 721,289 | 4/1942 | Germany | 102/40 |

*Primary Examiner*—David H. Brown
*Attorney, Agent, or Firm*—Bailin L. Kuch

[57] ABSTRACT

A gun and ammunition system is provided which utilizes the difference in density between the combustion gases and the charge of liquid propellant as the source of energy for the injection of propellant into the combustion chamber.

5 Claims, 18 Drawing Figures

10
12
14
16
18
20

30
32

34
35
36
38

40
42
44
46

48
50
52
54

30
60

30
60

30
62

64
66
65
30

68
35 or 42

70
35 or 42

108
104
124
111c
122
100
111
110
102
111b
111a
120
112
X
106
116
118
114

LIQUID PROPELLANT WEAPON SYSTEM

RELATED CASE

This application is a division of Ser. No. 575,283, filed May 7, 1975, now U.S. Pat. No. 4,011,817. This application is also a division of Ser. No. 707,144, filed July 20, 1976, which was a division of Ser. No. 469,507, filed May 13, 1974, now abandoned.

BACKGROUND OF THE INVENTION

1. Field of the Invention

This invention relates to weapons systems employing a liquid propellant, and particularly to such systems wherein the propellant is continuously pumped into the combustion chamber aft of the projectile as the projectile advances along the firing bore.

2. Prior Art

In my earlier patent application, Ser. No. 469,507, filed May 13, 1974, now abandoned, and continued as Ser. No. 707,143 and Ser. No. 707,144, both filed July 20, 1976, I disclosed a gun and ammunition system utilizing a round of ammunition carrying a relatively narrow diameter and relatively high mass projectile in a relatively wide and relatively low mass sabot which is initially accelerated by a primary propellant charge in the combustion chamber aft of the projectile and which is passed during a relatively extended period of time to the combustion chamber. Additional prior art is cited and discussed in that application which is hereby incorporated by reference.

SUMMARY OF THE INVENTION

An object of this invention is to provide a gun and ammunition system utilizing a liquid propellant traveling charge which is simpler than the area differential system disclosed in Ser. No. 469,507 supra.

A feature of this invention is the provision of a gun and ammunition system which utilizes the difference in density between the combustion gases and the charge of liquid propellant as the source of energy for the injection of propellant into the combustion chamber.

During the combustion of the propellant, an extremely steep inertial gradient exists between the face of the gun bolt and the projectile; and the lighter combustion gas propagates forwardly into the liquid charge of propellant. An injector device is provided which has a lower average density than the density of the liquid charge and which utilizes this difference in density to control the entrance of liquid propellant in the combustion zone or chamber. The injector device also defines and controls the interface between the liquid propellant and the combustion gas and provides a true traveling charge effect.

BRIEF DESCRIPTION OF THE DRAWING

These and other objects, features, and advantages of this invention will be apparent from the following specification thereof taken in conjunction with the accompanying drawing in which.

DESCRIPTION OF THE EMBODIMENTS

Taylor cavity formation and subsequent Helmholtz mixing are considered fundamental mechanisms in bulk-loaded liquid propellant guns. Behavior of the liquid gas interface, and hence of combustion processes, are attributed to these phenomena. The dynamics of two-phase flow under accelerations as extreme as those in guns support this supposition, and evidence exists to confirm it. Though chamber pressures are higher than critical, and transition between phases takes place differently than at lower pressure levels, large density differences must exist between burned and unburned charges. The less dense regions of combustion products undoubtedly migrate through the denser unburned propellant. Much turbulence and liquid break-up certainly occurs.

Figures 1, 2A, 2B, 2C, 2D, 3A, 3B:
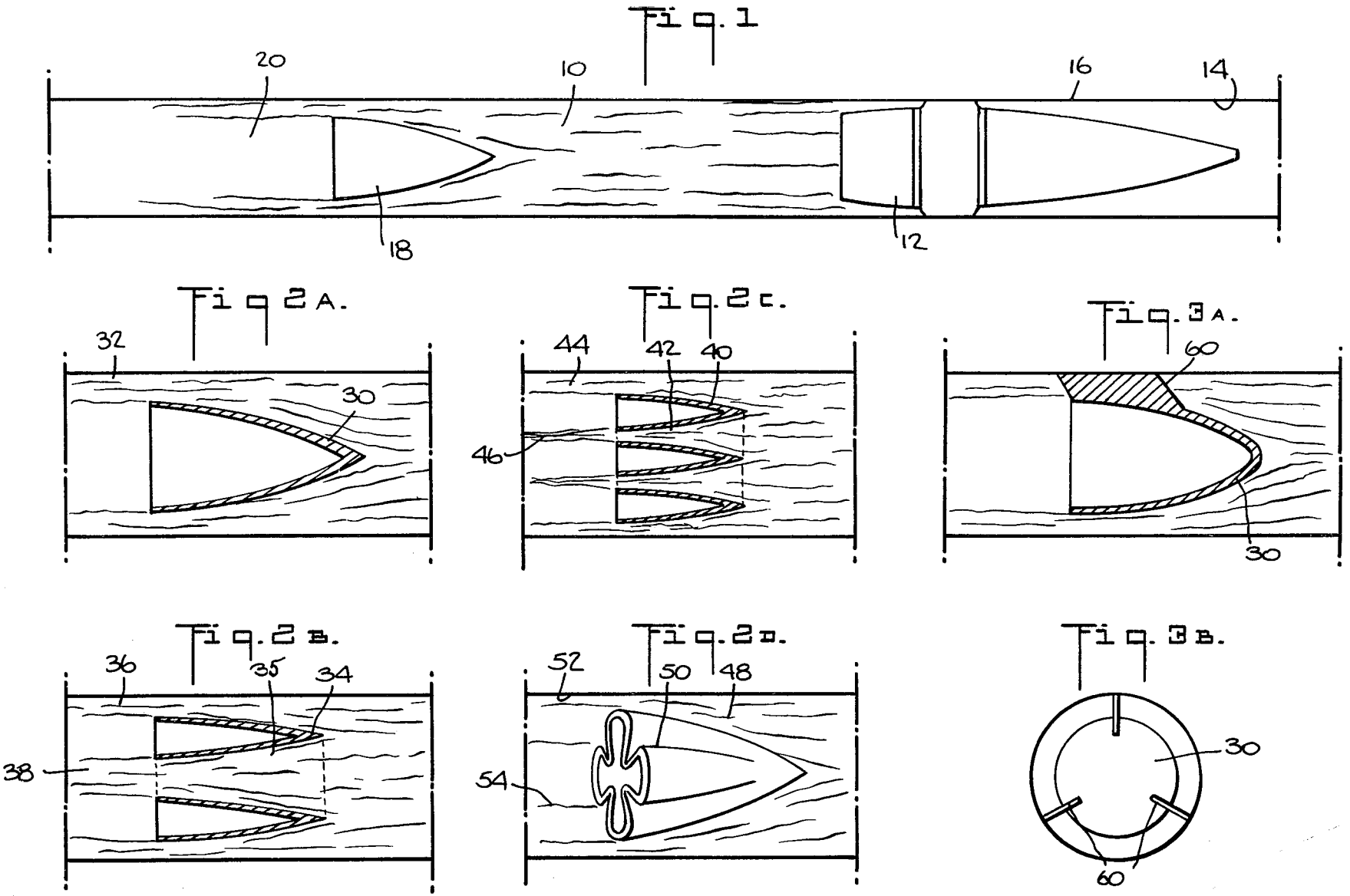
FIG. 1 is a schematic view of a gun and ammunition system embodying this invention.
FIGS. 2A, 2B, 2C, and 2D are schematic views of various species of cavity generators embodying this invention.
FIGS. 3A and 3B are schematic views of a fin-stabilized cavity generator embodying this invention.

FIG. 1 shows a liquid propellant traveling charge 10 behind a projectile 12 in a bore 14 in a gun barrel 16. Acceleration is taking place toward the right. Behind the liquid charge is shown a new component: a cavity generator 18. This is here shown as an ogive having a circular arc body of revolution. Behind the cavity generator 18 is the combustion zone 20 containing the hot gases which constitute the products of combustion. The cavity generator substantially separates the main body of the liquid charge from the combustion gases.

The design of the cavity generator 18 gives it another more significant function. It is constructed so that its density is less than that of the liquid charge 10 surrounding it. In the high inertial gradient associated with acceleration in the gun barrel, the lighter cavity generator will tend to penetrate the liquid charge. This is analogous to the penetration of gas in the Taylor cavity theory as applied to guns. As the cavity generator penetrates, it will displace liquid which necessarily flows rearward of the generator in a relative sense. The cavity generator thus acts as an injector system, controlling the rate at which liquid charge enters the combustion zone. As it penetrates into the liquid charge, the cavity generator literally shapes and controls a quasi-Taylor cavity.

FIG. 1 shows the cavity generator as a solid displacement body of appropriate density to aid in visualization. However, a solid body of revolution is not necessarily the most practical arrangement for actual application. It occupies volume in the chamber before firing, and it must be expelled as debris after the projectile leaves the muzzle. It is advantageous to reduce its bulk.

One way of reducing the bulk of the cavity generator is to make the generator hollow. Instead of a solid body, it becomes a thin shell, open at the rear and filled with combustion gas. The products of combustion will have variable density as pressure changes, but the average density of the products of combustion and the generator will always be less than that of the unburned liquid charge.

In this approach, the lightest, thinnest design is utilized. The cavity generator acts more as a gas-filled balloon or membrane than as a solid displacement body.

Other species have utility. Multiple shells can be used in place of a single one, and possibilities arise for varying the character of propellant flow into the combustion zone.

FIGS. 2A through 2D show four different examples of cavity generator design, each of which will produce its own pattern of propellant flow. FIG. 2A shows a single shell 30 construction, providing a conventional Taylor cavity configuration with a single wall of fluid 32. FIG. 2B shows a single shell 34 having a central bore 35, providing a single outer wall of fluid 36 and a central column of fluid 38. FIG. 2C shows a single shell 40 having an annular row of bores 42, providing a single outer wall of fluid 44 and an annular row of columns of fluid 46. FIG. 2D shows a single shell 48 having an annular row of flutes 50 in the surface thereof, providing a single outer wall of fluid 52 with an annular row of ridges 54.

One or more stabilizing fins 60 may be provided as shown in FIGS. 3A and 3B to maintain the generator on a longitudinal axial path while providing a thick outer wall of fluid.

Features incorporated into cavity generator design can further modify the character of the propellant/gas interface. FIGS. 4A through 4D illustrate a number of species. Each of these will affect the nature of the propellant surface exposed to combustion products, with resultant effect upon burning.

Figures 4A, 4B, 4C, 4D, 6:
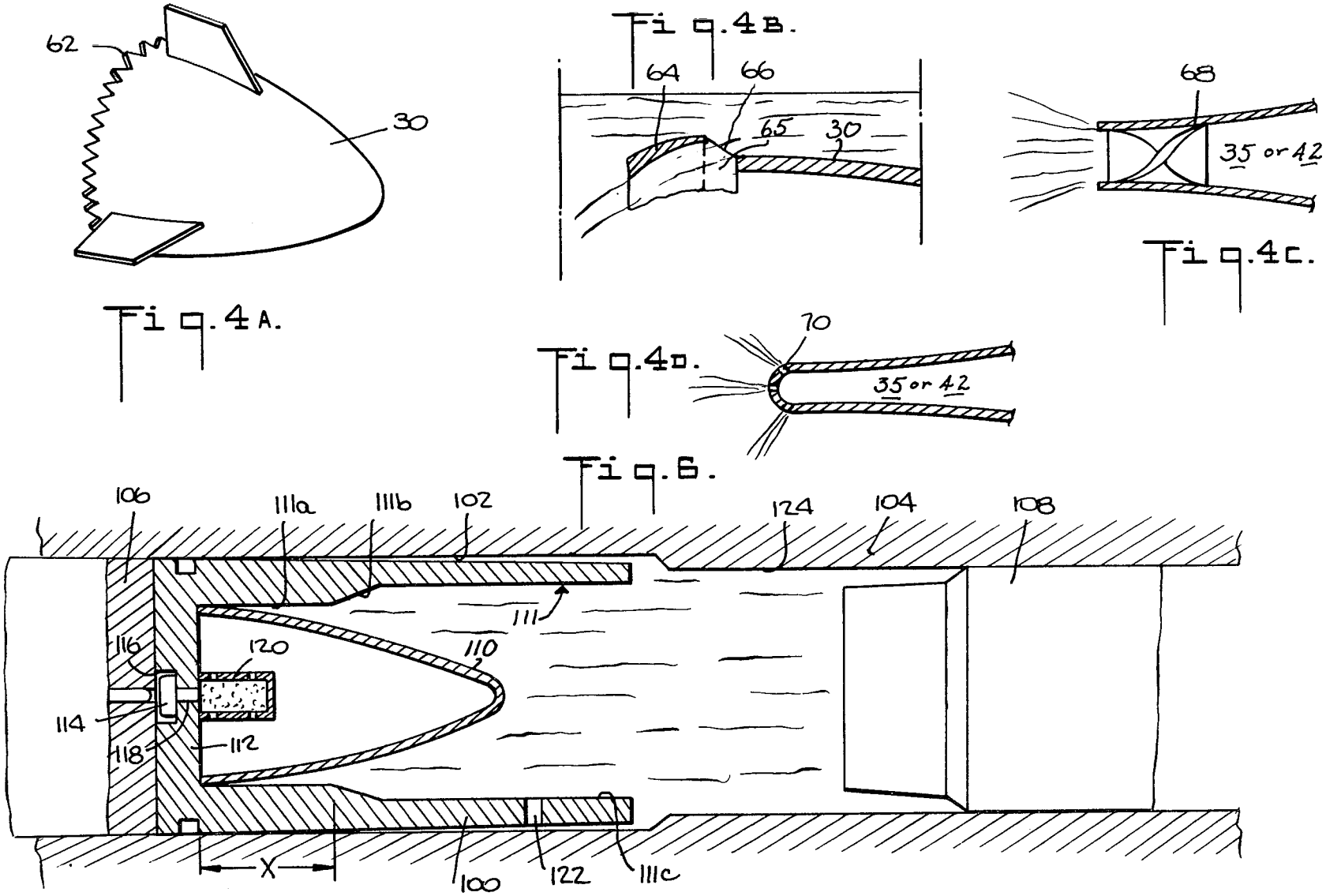
FIGS. 4A, 4B, 4C, and 4D are schematic detail views of additional species of cavity generators embodying this invention.
FIG. 6 is a detail view in longitudinal cross-section of the round of FIG. 5D.

FIG. 4A shows a series of serrations 62 provided in the trailing edge of the shell 30 and bent outwardly to act as flow spoilers. FIG. 4B shows a series of tabs 64 spaced by apertures 65 and webs 66 from the trailing edge of the shell 30 and bent inwardly to deflect portions of flowing outer wall of liquid into the combustion chamber. FIG. 4C shows a swirl generator 68 disposed in each bore 35 or 42. FIG. 4D shows a closure with a plurality of small orifices 70 disposed in each bore 35 or 42 for the injection of streams of propellant into the combustion chamber.

The cavity generator represents debris which must leave the muzzle of the gun behind the projectile. Unless it is made completely frangible or consumable, the cavity generator concept is not as well adapted to aircraft guns as to ground-based applications. The lowest possible weight is necessary, however, and the mass expelled must be minimal for most applications.

Figure 5A:
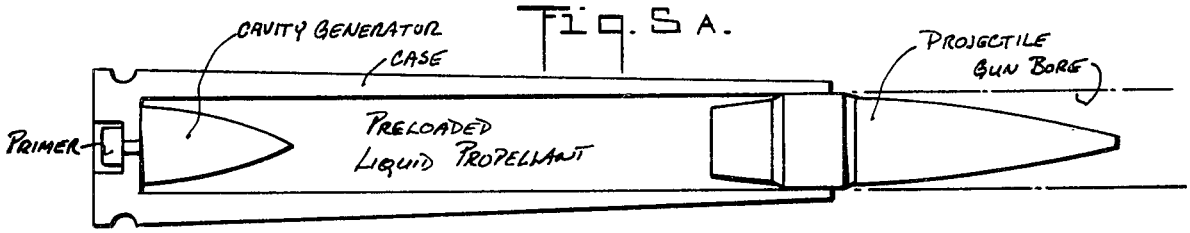
FIGS. 5A and 5B are schematic longitudinal cross-section views of two species of a cased, pre-loaded liquid propellant round of ammunition embodying this invention.
Figure 5B:
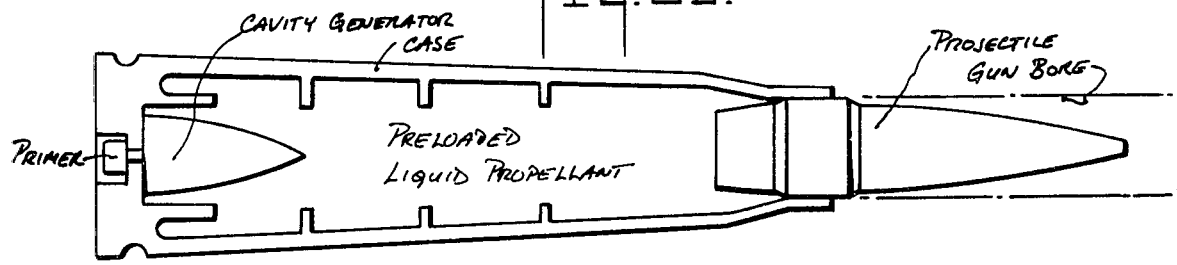
Figure 5C:
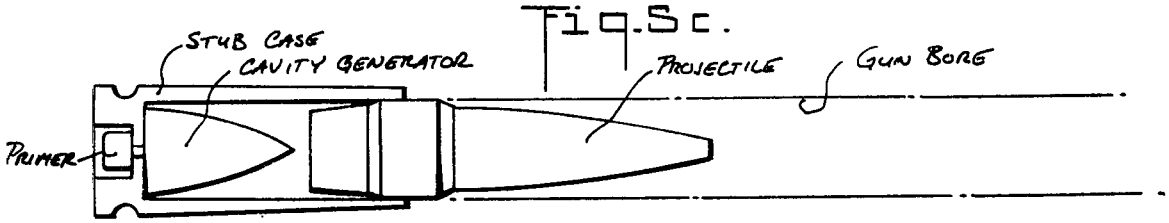
FIGS. 5C and 5D are schematic longitudinal cross-section views of a stub-cased, in-the-gun-filled round of ammunition before and after loading with liquid propellant, respectively, and embodying this invention.
Figure 5D:
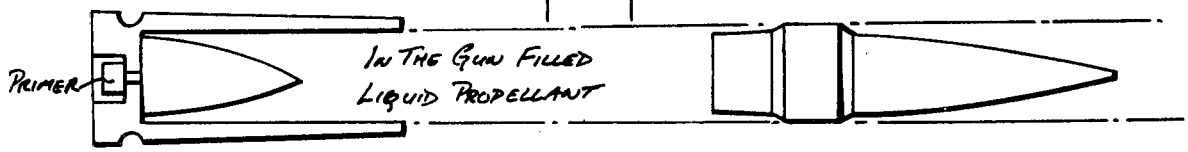
Figure 5E:
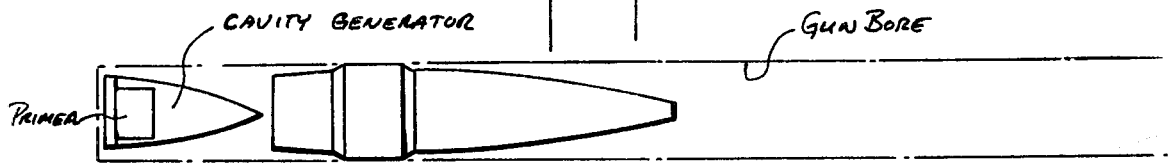
FIGS. 5E and 5F are schematic longitudinal cross-section views of a caseless, in-the-gun-filled round of ammunition before and after loading with liquid propellant, respectively, and embodying this invention.
Figure 5F:
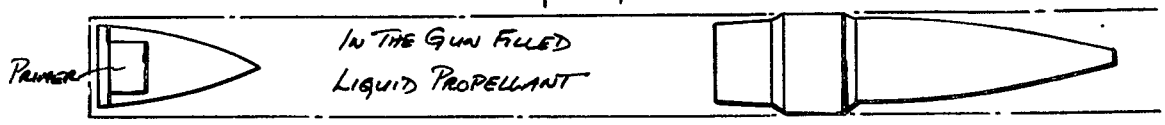

The cavity generator leaves the gun concurrently with the projectile and so has the advantage of being a one-shot component. It is most practical to combine the cavity generator with a priming system and to supply these components to the gun together with the projectile. Such an approach proves to be quite flexible in its applicability. FIGS. 5A through 5F illustrate three different arrangements. FIGS. 5A and 5B show a fully preloaded, cased configuration round, as employed in guns handling conventional ammunition. FIGS. 5C and 5D show a stub-case, dry-loaded round in-the-gun-filled configuration. FIGS. 5E and 5F show a caseless, generator and projectile individually loaded round, in-the-gun-filled configuration. For details of the loading and filling operations, reference should be had to my disclosure in U.S. Pat. Application Ser. No. 469,507, filed May 13, 1974.

It is necessary to initiate the inertial field which produces the Taylor cavity behind the injector quickly, before combustion progresses out into the charge ahead of the cavity generator 30. FIG. 6 shows a stub case, dry loaded, in-the-gun-filled round of ammunition, similar to that shown in FIG. 5D. The stub case 100 is locked into the chamber 102 of the barrel 104 by a bolt 106. A projectile 108 closes the open end of the case. A cavity generator 110 is disposed within the bore 111 of the case against the base 112 thereof. The bore 111 has a portion of smallest diameter **111*a* adjacent the base, a portion of enlarging diameter 111*b*, and a portion of largest diameter 111*c* adjacent the mouth of the case. The outside diameter of the base of the generator is made equal to the inside diameter of the bore portion 111*a*. A primer 114 is fixed in a cup 116 in the base 112 and communicates through a flash bore 118 with a booster 120 which is fixed to the base within the case and within the generator 110. Liquid propellant is charged into the case through a port 122 in the case from a valving system which is not shown. The charge of liquid propellant displaces the projectile forwardly into the bore 124 of the barrel 104. The primer is fired to initiate the booster to generate hot gas for the ignition of the charge of liquid propellant. At first, the booster-generated gas is confined within the hollow shell of the generator 110. The pressure of the booster-generated gas begins to accelerate the assembly of the generator, the charge of liquid propellant and the projectile, which assembly will travel a distance (X) before the hot booster-generated gas and the liquid propellant will meet. This distance (X) is predetermined by the longitudinal length of the bore portion 111*a* in the case. The rate of initial intermixing of the hot gas and the propellant can be controlled by varying the taper of the diameter of the bore portion 111*b*. The stabilizing fin 60 of FIG. 3A, if required, may extend from the forward part of the generator to the bore portion 111*a*.**

A simplified analysis of the cavity generator system follows: Muzzle velocity and pressure-time relationships in the chamber are the parameters of most interest in assessing performance. Turning again to the basic arrangement illustrated in FIG. 1, the key factor in controlling combustion is the rate at which propellant enters the combustion zone from around the periphery of the cavity generator. This, in turn, is a direct result of the rate at which the cavity generator penetrates the unburned charge, for it is this action which displaces fluid rearward into the combustion chamber. The first step, therefore, is to establish the velocity of the cavity generator relative to the liquid charge and projectile.

From equations for the cavity generator and the liquid charge, an expression has been developed for the velocity with which the cavity generator penetrates the charge, as a function of various parameters. The expression for penetration velocity is:

$$V_2 = \sqrt{\frac{2aV_{CG}(1 - \frac{\Gamma_{CG}}{\Gamma_L})}{A_c(\frac{A_c^2}{(A_c - A_1)^2} - 1)}}$$

where $V_2$ = penetration velocity
$a$ = projectile acceleration
$Y_{CG}$ = specific gravity of cavity generator
$Y_L$ = specific gravity of liquid propellant
$V_{CG}$ = volume of cavity generator
$A_1$ = cavity generator base area
$A_c$ = bore area Penetration velocity gives a measure of the flow rate of propellant into the combustion zone. This can be combined with equations for the energy balance within the gun chamber to calculate chamber pressure and projectile motion as functions of time.

What is claimed is:

1. A method of propelling a projectile from a bore of a gun comprising:

providing a series in said bore of said gun a projectile, a charge of liquid propellant aft of said projectile, and a cavity generator aft of said projectile and said charge;

providing a volume of combustion gas in said bore of said gun aft of said cavity generator to create a combustion cavity; and translating said generator forwardly into said charge of liquid propellant to enlarge said combustion cavity and to pass liquid propellant aftwardly into said cavity.

2. A method according to claim 1 further including:

finely dividing the liquid propellant as it is passed into the combustion cavity.

3. A method according to claim 1 further including:

passing the liquid propellant into said combustion cavity at a rate which is a function of the penetration velocity of the generator into the charge of liquid propellant.

4. A method according to claim 1 wherein:

said cavity generator has a forward face and an aft face, the cross-sectional area of said forward face being equal to the cross-sectional area of said aft face.

5. A method according to claim 1 wherein:

the average density of said cavity generator is less than the average density of said charge of liquid propellant.

* * * * *

UNITED STATES PATENT OFFICE

CERTIFICATE OF CORRECTION

Patent No. 4,051,762 Dated October 4, 1977

Inventor(s) Eugene Ashley

It is certified that error appears in the above-identified patent and that said Letters Patent are hereby corrected as shown below:

Column 5, line 3 change "$\gamma_{CG}$" to -- $\Gamma_{CG}$--; line 4 change "$\gamma_L$" to -- $\Gamma_L$--; line 16 change "a" to --in--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*